US008470507B2

(12) United States Patent
Ito

(10) Patent No.: US 8,470,507 B2
(45) Date of Patent: Jun. 25, 2013

(54) HYBRID DEVELOPING CARRIER, HYBRID DEVELOPING DEVICE AND IMAGE-FORMING APPARATUS

(75) Inventor: Noboru Ito, Kawanishi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 974 days.

(21) Appl. No.: 12/334,739

(22) Filed: Dec. 15, 2008

(65) Prior Publication Data

US 2009/0154963 A1 Jun. 18, 2009

(30) Foreign Application Priority Data

Dec. 18, 2007 (JP) ..... 2007-326035

(51) Int. Cl.
*G03G 9/113* (2006.01)

(52) U.S. Cl.
USPC ..... 430/111.1; 430/111.35; 399/270

(58) Field of Classification Search
USPC 430/111.35, 111.32, 111.33, 111.1; 399/270, 399/282, 285
See application file for complete search history.

(56) References Cited

U.S. PATENT DOCUMENTS

| | | | | |
|---|---|---|---|---|
| 6,106,987 | A * | 8/2000 | Hakata et al. | 430/111.35 |
| 2003/0161665 | A1 | 8/2003 | Ozeki et al. | |
| 2004/0190947 | A1 | 9/2004 | Takeuchi et al. | |
| 2007/0059047 | A1 | 3/2007 | Kamiya et al. | |
| 2007/0092306 | A1 * | 4/2007 | Matsuura et al. | 399/267 |

FOREIGN PATENT DOCUMENTS

| | | |
|---|---|---|
| JP | 08-286429 | 11/1996 |
| JP | 2002-207321 | 7/2002 |
| JP | 2003-066656 | 3/2003 |
| JP | 2003-233222 | 8/2003 |
| JP | 2003-280283 | 10/2003 |
| JP | 2004-198664 | 7/2004 |
| JP | 2004-198833 | 7/2004 |
| JP | 2004-226506 | 8/2004 |
| JP | 2005-233988 | 9/2005 |
| JP | 2006-058811 | 3/2006 |
| JP | 2006-308687 A | 11/2006 |
| JP | 2007-086092 | 4/2007 |
| JP | 2007-264097 | 10/2007 |

OTHER PUBLICATIONS

Decision of Patent Grant dated Jul. 6, 2010, issued in the corresponding Japanese Patent Application No. 2007-326035, and an English Translation thereof.

Notification of Reasons for Refusal issued in corresponding Japanese Application No. 2007-326035 dated Oct. 20, 2009, and an English Translation thereof.

* cited by examiner

*Primary Examiner* — Janis L Dote
(74) *Attorney, Agent, or Firm* — Buchanan Ingersoll & Rooney

(57) ABSTRACT

A hybrid developing carrier, comprising a resin layer formed on an outermost surface, wherein the surface of said resin layer is provided with sites formed of an inorganic compound having basic points or acidic points and sites where the resin forming the resin layer is exposed, a hybrid developing device equipped with the hybrid developing carrier, and an image-forming apparatus equipped with the hybrid developing device.

6 Claims, 10 Drawing Sheets

(A)

(B)

(A)

(B)

HYBRID DEVELOPING CARRIER, HYBRID DEVELOPING DEVICE AND IMAGE-FORMING APPARATUS

This application is based on application No. 2007-326035 filed in Japan, the contents of which are hereby incorporated by reference.

BACKGROUND OF THE INVENTION

1. Field of the Invention

The present invention relates to an image-forming apparatus of an electrophotographic system, a hybrid developing device for use in the image-forming apparatus, and a hybrid developing carrier to be used in the developing device.

2. Description of the Related Art

With respect to the developing system used for an image-forming apparatus of the electrophotographic system, a mono-component developing system that uses only a toner as a main component of a developer and a two-component developing system that uses a toner and a carrier as main components of a developer have been known.

A developing device of the mono-component developing system is provided with a toner supporting member that supports and transports toner and a frictional charging member that is made in contact with the toner supporting face of the toner supporting member. Upon passing through the contact position to the frictional charging member, the toner, supported on the toner supporting member, is made in friction-contact with the frictional charging member to be formed into a thin layer, and also charged to a predetermined polarity. In this manner, since the charging process of the toner is carried out by using the frictional contact to the frictional charging member, the mono-component developing device has advantages in that its structure has a small size, and is simple and inexpensive. However, since the toner is subjected to a strong stress at the contact position to the frictional charging member, the toner tends to deteriorate, and the toner chargeability is consequently degraded comparatively earlier. Due to a contact pressure between the toner supporting member and the frictional charging member, the toner tends to adhere to the two members to cause degradation in the toner charging ability, resulting in a comparatively short service life of the developing device.

In a developing device of the two-component developing system, since, by making the toner and carrier in frictional contact with each other, the two components are charged to predetermined polarities, the stress to be applied to the toner is comparatively small in comparison with that in the mono-component developing device. Since the surface area of the carrier is comparatively larger than that of the toner, the device is less subject to toner adhesion and the resulting contamination. However, since the carrier moving speed is higher than that of a latent image-supporting member in the developing area, a phenomenon in which the toner developed on the latent image-supporting member is scraped by the carrier, that is, a so-called scavenging, tends to occur to cause an image loss.

Japanese Patent Application Laid-Open No. 2006-308687 has proposed one example of a hybrid developing system in which, as shown in FIG. 11, from a developer that contains a toner 202 and a carrier 203 held on the outer circumferential face of a magnetic roller 201, only the toner is selectively supplied to the outer circumferential face of a developing roller 204, and by using the toner held on the outer circumferential face of this developing roller, an electrostatic latent image (electrostatic latent image portion) on a photosensitive member 205 is developed. A magnetic material particle, such as ferrite, a coat-type carrier formed by simply placing a resin coat film on the surface of each magnetic material particle, and a dispersion-type carrier formed by dispersing magnetic powder in a binder resin are used as carriers. In this hybrid developing system, the stress, exerted in the mono-component developing system upon charging the toner, can be reduced, and the image loss due to the carrier upon developing in the two-component developing system can be prevented.

In the hybrid developing system, in a toner supply/recovery area between the magnetic roller 201 and the developing roller 204, the carrier has to recover residual toner on the developing roller 204, while supplying the toner. However, a problem arises in which the recovering process of the residual toner by the carrier is not carried out sufficiently. When the recovery of the residual toner is insufficient, with the amount of toner on the developing roller being irregular, the toner is supplied thereon, so that a problem of so-called ghost in which the irregularity appears on an image upon developing tends to occur. This is a phenomenon in which the same image as an image previously formed by one rotation of the developing roller faintly appears on a printed image.

The objective of the present invention is to provide a hybrid developing carrier that can sufficiently recover residual toner on the developing roller in the hybrid developing system, and prevent a ghost from occurring, as well as a hybrid developing device and an image-forming apparatus.

BRIEF SUMMARY OF THE INVENTION

The present invention provides a hybrid developing carrier, comprising a resin layer formed on an outermost surface, wherein the surface of said resin layer is provided with sites formed of an inorganic compound having basic points or acidic points and sites where the resin forming the resin layer is exposed, a hybrid developing device equipped with the hybrid developing carrier, and an image-forming apparatus equipped with the hybrid developing device.

DETAILED DESCRIPTION OF THE INVENTION

Figure 1:
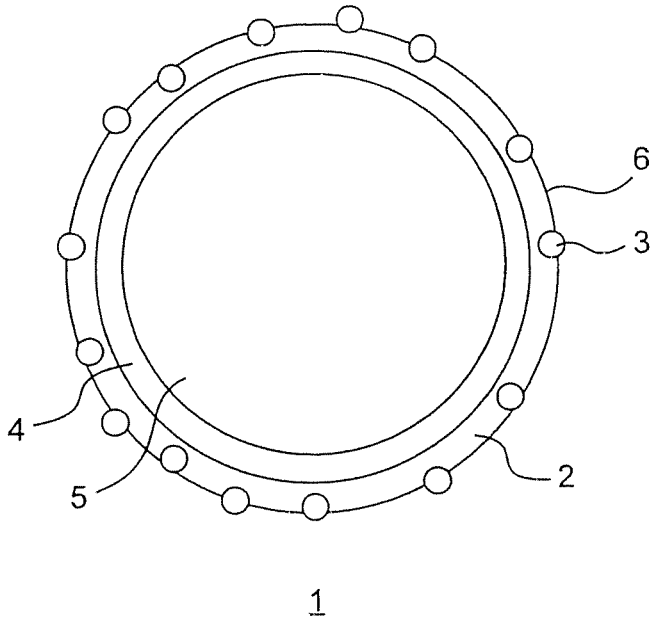
FIG. 1 is a schematic structural drawing that shows one embodiment of a carrier of the present invention.

The present invention relates to a hybrid developing carrier, comprising a resin layer formed on an outermost surface, wherein the surface of said resin layer is provided with sites formed of an inorganic compound having basic points or acidic points and sites where the resin forming the resin layer is exposed.

The present invention also relates to a hybrid developing device that visualizes an electrostatic latent image on an electrostatic latent image-supporting member by using a developer containing a toner and a carrier, comprises:

a developer containing a toner and the above-mentioned hybrid developing carrier;

a first transporting member placed at an opening of a developer tank holding the developer;

a second transporting member that faces the first transporting member via a first area interposed therebetween, and the above-mentioned electrostatic latent image-supporting member via a second area interposed therebetween;

a first electric field-forming means that forms a first electric field between the first transporting member and the second transporting member so that the toner in the developer held by the first transporting member is transported onto the above-mentioned second transporting member; and a second electric field-forming means that forms a second electric field between the second transporting member and the electrostatic latent image-supporting member so that the toner held by the second transporting member is transported onto the electrostatic latent image on the electrostatic latent image-supporting member so as to visualize the electrostatic latent image. The present invention also relates to an image-forming apparatus provided with the hybrid developing device.

[Effects of the Invention]

When the resin layer surface of the hybrid developing carrier of the present invention has sites formed of an inorganic compound having basic points, carriers are allowed to have a newly generated positive charge at each basic point by mutual frictional contacts among the carriers so that the inorganic compound sites have a positive chargeability. For this, when the carrier is used together with a negatively chargeable toner, since the inorganic compound sites electrically attract the negatively chargeable toner, the toner recovering ability of the carrier is improved, thereby making it possible to prevent the generation of ghost.

When the resin layer surface of the hybrid developing carrier of the present invention has sites formed of an inorganic compound having acidic points, carriers are allowed to have a newly generated negative charge at each acidic point by mutual frictional contacts among the carriers so that the inorganic compound sites have a negative chargeability. For this, when the carrier is used together with a positively chargeable toner, since the inorganic compound sites electrically attract the positively chargeable toner, the toner recovering ability of the carrier is improved, thereby making it possible to prevent the generation of ghost.

[Hybrid Developing Carrier]

The hybrid developing carrier of the present invention (hereinafter, referred to simply as "carrier"), comprising a resin layer as an outermost surface, is designed so that the surface of the resin layer is provided with sites made of an inorganic compound having basic points or acidic points and sites to which the resin forming the resin layer is exposed. FIG. 1 is a schematic structural drawing that shows one example of the carrier of the present invention. As shown in FIG. 1, the surface of a resin layer 2, which is the outermost surface of the carrier 1, is provided with sites 3 made of an inorganic compound (hereinafter, referred to as inorganic compound sites) and sites 6 to which the resin forming the resin layer 2 is exposed (hereinafter, referred to as resin sites).

That the inorganic compound has basic points means that, when the inorganic compound is dispersed in cyclohexane and a basic property indicator is added thereto, the dispersion solution is changed into a color indicating the basic property. By setting the dispersion amount of the inorganic compound to about 5% by weight relative to an organic solvent, the color change can be sufficiently recognizable.

For example, when an inorganic compound having basic points is dispersed in cyclohexane and a cyclohexane solution of nitrodiphenyl amine is added thereto, the dispersion solution is changed into orange.

When an inorganic compound having basic points is dispersed in cyclohexane and a cyclohexane solution of bromothymol blue is added thereto, the dispersion solution is changed into blue.

With respect to the inorganic compound having basic points, examples thereof include Al2O3, CaO, MgO, BeO, ZnO, Na2CO3, K2CO3 and SrCO3, and two or more kinds of these may be used in combination.

Figure 2:
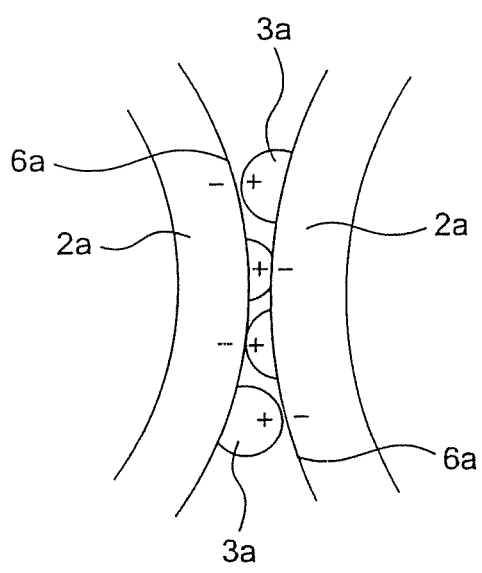
FIGS. 2(A) and 2(B) are enlarged schematic drawings of the carriers, each of which shows a charged state when the carriers of the present invention are made in friction-contact with each other.
Figure 2:
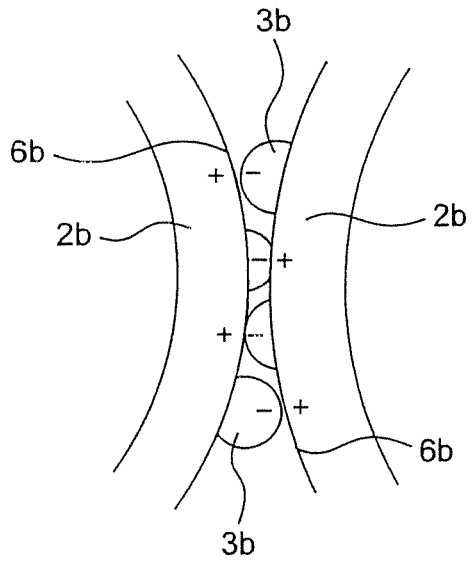

Carriers, each comprising inorganic compound sites having basic points on its resin layer surface, are allowed to have a newly generated positive charge at each basic point by mutual frictional contacts among the carriers so that the inorganic compound sites have a positive chargeability. That is, as shown in FIG. 2(A), by the frictional contacts between inorganic compound sites 3*a* having basic points on one carrier and resin sites 6*a* of resin layer 2*a* on the other carrier, the inorganic compound sites 3*a* have a positive charge, while the resin sites 6*a* have a negative charge. For this, when the carrier is used together with a negatively chargeable toner, the inorganic compound sites 3*a* function as heteropolar sites that are charged to have the heteropolarity to the toner, while the resin sites 6*a* function as isopolar sites that are charged to have the same polarity as the toner. As a result, upon supplying and recovering toner by a hybrid developing process, since the inorganic compound sites 3*a* (heteropolar sites) electrically attract the negatively chargeable toner, the toner recovering ability of the carrier is improved so that it becomes possible to prevent the occurrence of ghost.

With respect to the element resin of the resin layer 2*a*, not particularly limited as long as it is allowed to have a negative charge through the frictional contact with the inorganic compound sites 3*a*, for example, materials, such as a polyester resin, a fluororesin and a polystyrene-acrylic copolymer, are preferably used from the viewpoint of easiness to be charged into the negative polarity. For example, a negative charge controlling agent may be added to the resin layer 2*a* so that a negatively chargeability may be applied to the resin sites. With respect to the negative charge controlling agent, the same charge controlling agent as a negative charge controlling agent to be contained in a negatively chargeable toner, which will be described layer, may be used. In the present specification, the acryl means (meth)acrylate and (meth) acrylic acid.

Regardless of the element resin of the resin layer 2*a*, normally, the resin sites 6*a* are allowed to have a negative charge, while the inorganic compound sites 3*a* may have a positive charge, by the contacts between the resin sites 6*a* and the inorganic compound sites 3*a*. It is considered that the corresponding phenomenon takes place based upon the following mechanism. When the inorganic compound has basic points, the compound has hydroxide groups or lone-pairs of electron pairs on its surface, and these make it possible to incorporate protons or other positively chargeable ions, and consequently to exert a positive chargeability.

Preferable combinations between the inorganic compound forming the inorganic compound sites 3*a* and the element resin for the resin sites 2*a* are as follows:

(A1) Zinc oxide-Polystyrene-Acrylic Copolymer Resin;

(A2) Alumina-Polyester Resin;

(A3) Magnesium Oxide-Polystyrene-Acrylic Copolymer Resin;

(A4) $SrCO_3$-Polystyrene-Acrylic Copolymer Resin;

(A5) Alumina+Zinc Oxide-Polystyrene-Polymethacrylate Copolymer;

(A6) Alumina+Zinc Oxide-Polyester;

(A7) $Na_2CO_3$-Polyester;

(A8) Magnesium Oxide-Polyester; and (A9) $K_2CO_3$-Polyester (or Polystyrene-Methacrylate Copolyer).

That an inorganic compound has acidic points means that, when the inorganic compound is dispersed in cyclohexane to which an acidic indicator is added, the dispersing solution changes its color into a color indicating an acidity. When the dispersed amount of the inorganic compound is made to the same level as that of the inorganic compound having basic points, the color change is sufficiently recognizable.

For example, when an inorganic compound having acidic points is dispersed in cyclohexane to which a cyclohexane solution of benzalacetophenone is added, the dispersing solution is changed into red.

With respect to the inorganic compound having acidic points, examples thereof include: $SiO_2$, $TiO_2$, $V_2O_5$, $MnSO_4$, $NiSO_4$, $MgSO_4$, $BaSO_4$, $Al_2(SO_4)_3$, $AlPO_4$, $AlCl_3$, $SnCl_2$, AgCl, $CuCl_2$, $Mg(ClO_4)$ and CaS, and two or more kinds of these may be used in combination.

Carriers, each comprising inorganic sites having acidic points on its resin layer surface, are allowed to have a newly generated negative charge at each acidic point by mutual frictional contacts among the carriers so that the inorganic compound sites have a negative chargeability. That is, as shown in FIG. 2(B), by the frictional contacts between inorganic compound sites 3*b* having acidic points on one carrier and resin sites 6*b* of resin layer 2*b* on the other carrier, the inorganic compound sites 3*b* have a negative charge, while the resin sites 6*b* have a positive charge. For this, when the carrier is used together with a positively chargeable toner, the inorganic compound sites 3*b* function as heteropolar sites that charge the toner to the heteropolarity, while the resin sites 6*b* function as isopolar sites that are charged to have the same polarity as the toner. As a result, upon supplying and recovering toner by a hybrid developing process, since the inorganic compound sites 3*b* (heteropolar sites) electrically attract the positively chargeable toner, the toner recovering ability of the carrier is improved so that it becomes possible to prevent the occurrence of ghost.

With respect to the element resin of the resin layer 2*b*, not particularly limited as long as it is allowed to have a positive charge through the frictional contact with the inorganic compound sites 3*b*, for example, materials, such as a polystyrene-acrylic copolymer, a polystyrene-acrylic copolymer to which an amino group is added, a polyimide resin and an amino-modified silicone resin, are preferably used from the viewpoint of easiness to be charged into the positive polarity. A positive charge controlling agent may be added to the resin layer 2*b* so that a positive chargeability may be applied to the resin sites. With respect to the positive charge controlling agent, the same controlling agent as the positive charge controlling agent to be contained in a positively chargeable toner, which will be described later, may be used.

Regardless of the element resin of the resin layer 2*b*, normally, the resin sites 6*b* are allowed to have a positive charge, while the inorganic compound sites 3*b* are allowed to have a negative charge, by the contact between the resin sites 6*b* and the inorganic compound sites 3*b*. It is considered that the phenomenon takes place based upon the following mechanism. The fact that a solid substance exhibits an acidity indicates that the substance has protons on its surface or a structure that can incorporate electrons or negative ions. Therefore, the substance exhibits a negative chargeability by supplying protons to the counterpart in contact therewith or by receiving negative ions therefrom.

Preferable combinations between the inorganic compound forming the inorganic compound sites 3*b* and the element resin for the resin sites 2*b* are as follows:

(B1) Magnesium Sulfate-Polystyrene-Acrylic Copolymer Resin;

(B2) Aluminum Chloride-Polystyrene-Acrylic Copolymer Resin;

(B3) Titanium Oxide-Polyester (or Polystyrene-Methylmethacrylate Copolymer);

(B4) $NiSO_4$-Polyester (or Polystyrene-Methylmethacrylate Copolymer);

(B5) $BaSO_4$-Polyester (or Polystyrene-Methylmethacrylate Copolymer);

(B6) $Mg(ClO_4)$-Polyester (or Polystyrene-Methylmethacrylate Copolymer);

(B7) $Al_2(SO_4)_3$-Polyester (or Polystyrene-Methylmethacrylate Copolymer); and (B8) $MnSO_4$-Polyester (or Polystyrene-Methylmethacrylate Copolymer).

Even when the inorganic compound has the basic points or the acidic points, the average primary particle size of the inorganic compound is not particularly limited, and is normally set to 0.01 to 2 μm, particularly to 0.05 to 0.8 μm. The mode of existence of the inorganic compound on the resin layer surface is not particularly limited as long as the objective of the present invention can be achieved, and may be prepared as either the mode of the primary particles or the mode of secondary particles. The inorganic compound is preferably prepared as the mode of primary particles from the viewpoint of increasing the charging points so as to effectively improve the toner recovering property.

Additives, such as carbon black and metal fine particles, may be contained in the resin layer 2 as long as the objective of the present invention is achieved.

Not particularly limited, the thickness of the resin layer 2 is normally set in a range from 0.1 to 2 μm, preferably from 0.2 to 1.0 μm.

A carrier 1 may have any structure as long as it has the resin layer 2 on its surface, and for example, as shown in FIG. 1, may have a structure in which an intermediate layer 4 and a resin layer 2 are successively formed on the surface of a core particle 5, or may have such a structure as the intermediate layer 4 is omitted. The core particle 5 may be a magnetic material particle such as a ferrite bead and a magnetite bead, which has been generally used, or may be a particle in which fine powder of the magnetic material particle is dispersed in a binder resin. The carrier 1 preferably has an intermediate layer 4, because a leak that occurs between the magnetic material particles of the core particle 5 and the inorganic compound of the resin layer 2 can be prevented. The intermediate layer 4 may be made of any resin, and normally, from the viewpoint of adhesive property, the same resin as that used for the resin layer 2 to be formed thereon may be used. Not particularly limited, the thickness of the intermediate layer 4 is normally set in a range from 0.01 to 1 μm, preferably from 0.1 to 0.5 μm.

The resin layer 2 is formed through methods in which a coating solution, obtained by dissolving and dispersing a predetermined resin, an inorganic compound, and optionally an additive in an organic solvent, is coated on a core particle 5 by using a conventionally known coating method, and the resulting coat layer is dried. In this method, since the inorganic compound is substantially evenly dispersed in the resin layer in the state of the primary particles, at least one portion of the inorganic compound is allowed to protrude from the surface of the resin layer 2 in the state of the primary particles to be exposed thereto. As a result, the surface of the resin layer 2 is allowed to have inorganic compound sites 3. With respect to the content of the inorganic compound to be used upon manufacturing the carrier by using the method, not particularly limited as long as the objective of the present invention is achieved, normally, it is set to 5 to 70 parts by weight, preferably to 20 to 50 parts by weight, relative to 100 parts by weight of the resin forming the resin layer 2.

The resin layer 2 is also formed through methods in which a coating solution, obtained by dissolving and dispersing a predetermined resin and optionally an additive on demand in an organic solvent, is coated on a core particle 5 by using a conventionally known coating method, and after the resulting coat layer has been dried to obtain a carrier precursor, a predetermined inorganic compound is injected into the coat layer of the carrier precursor by using a mechanical and/or thermal impact. At this time, for example, the carrier precursor and the inorganic compound may be uniformly mixed with each other, and after the inorganic compound has been adhered to the coat layer surface of the carrier precursor, the inorganic compound can be injected into the coat layer by applying a mechanical and/or thermal impact thereto using a hybridizer (made by Nara Machinery Co., Ltd.) or the like. In this case, the inorganic compound is not completely buried into the coat layer, but secured in such a manner that at least one portion thereof is allowed to protrude from the surface of the coat layer to be exposed thereto. As a result, the surface of the resin layer 2 is allowed to have inorganic compound sites 3. With respect to the content of the inorganic compound used upon manufacturing the carrier by using the corresponding method, not particularly limited as long as the objective of the present invention is achieved, normally, it is set to 5 to 70 parts by weight, preferably to 20 to 50 parts by weight, relative to 100 parts by weight of the carrier precursor.

Upon producing carriers having the intermediate layer 4, a coating solution, prepared by dissolving a predetermined resin, is coated onto the core particle 5 by using a conventionally known coating method, and a resin layer 2 is formed on the resulting dried coat layer.

The average particle size of the carrier 1 is normally set to 20 to 100 μm, particularly to 25 to 45 μm.

The mixing ratio between the carrier and the toner may be adjusted so as to provide a desired quantity of charge with the toner, and the mixing ratio of the toner is set in a range from 3 to 50% by weight, preferably from 6 to 30% by weight, with respect to the total amount of the toner and the carrier.

[Toner]

With respect to the toner, when the inorganic compound on the surface of the resin layer 2 of carrier has basic points, a negatively chargeable toner is used, and when the inorganic compound has acidic points, a positively chargeable toner is used. The negatively chargeable toner is a toner that is charged into the negative polarity upon frictional contact with the carrier, and the positively chargeable toner is a toner that is charged into the positive polarity upon frictional contact with the carrier.

The toner is formed by allowing a binder resin to contain at least a coloring agent, and a positive or negative charge controlling agent and a releasing agent are further optionally contained therein.

With respect to the binder resin used in the toner, upon producing a negatively chargeable toner, although not particularly limited, for example, a material, such as polyester and polystyrene-polyfluoroacrylate, which exerts a stronger negative chargeability, is preferably used. Upon producing a positively chargeable toner, for example, a material, such as a polystyrene-methacrylate copolymer that exerts a weak negative chargeability and polystyrene-aminoacrylate that exerts a strong positive chargeability, is preferably used.

With respect to the coloring agent, any conventionally known materials in the field of toners may be used, and examples thereof include: carbon black, Aniline Black, activated carbon, magnetite, Benzine Yellow, Permanent Yellow, Naphthol Yellow, Phthalocyanine Blue, Fast Sky Blue, Ultramarine Blue, Rose Bengal and Lake Red. In general, the amount of addition of the coloring agent is preferably set to 2 to 20 parts by weight relative to 100 parts by weight of the binder resin.

With respect to the charge controlling agent, any one of materials conventionally known as charge controlling agents in the field of toners may be used. Specific examples of the positive charge controlling agent include: a nigrosine dye, a quaternary ammonium salt compound, a triphenylmethane compound, an imidazole compound and a polyamine resin. Specific examples of the negative charge controlling agent include: an azo-based dye containing metal, such as Cr, Co, Al and Fe, a metal salicylate compound, a metal alkylsalicylate compound and a calix arene compound. The charge controlling agent is preferably used at a rate of 0.1 to 10 parts by weight relative to 100 parts by weight of the binder resin.

With respect to the releasing agent, any one of materials conventionally known as releasing agents in the field of toners may be used. Examples of the material for the releasing agent include: polyethylene, polypropylene, carnauba wax, sazol wax, or a mixture made by suitably combining these. The releasing agent is preferably used at a rate of 0.1 to 10 parts by weight relative to 100 parts by weight of the binder resin.

The toner may be manufactured by using any one of conventionally known methods in the field of toners, such as a pulverizing method, an emulsion polymerization method and a suspension polymerization method.

The toner particle size is set to, for example, about 3 to 15 μm.

A fluidizing agent may be added to the toner so as to enhance the fluidizing property. Examples of the fluidizing agent include: inorganic fine particles, such as silica, titanium oxide and aluminum oxide, and resin fine particles, such as a acrylic resin, a styrene resin, a silicone resin and a fluororesin.

In particular, a fluidizing agent, subjected to a hydrophobic treatment by a silane coupling agent, a titanium coupling agent, silicone oil or the like, is preferably used. The fluidizing agent is preferably used at a rate of 0.1 to 5 parts by weight relative to 100 parts by weight of the toner. The average primary particle size of these additives is preferably set to 9 to 100 nm.

[Image-Forming Apparatus]

The carrier of the present invention is used for a hybrid developing device and an image-forming apparatus provided with such a developing device. The hybrid developing system refers to a system in which a two-component developer, held on an outer circumferential face of a first transporting member (transporting roller), is transported to an area facing to a second transporting member (developing roller) so that only the toner is selectively supplied onto the outer circumferential face of the developing roller to form a toner thin layer on the outer circumferential face of the developing roller, and an electrostatic latent image on the electrostatic latent image-supporting member is developed by using the toner thin layer. With this arrangement, it is possible to reduce stress upon charging the toner, and consequently to prevent image loss due to the carrier upon developing.

Referring to attached drawings, preferred embodiments of the present invention will be described. In the following description, terms indicating specific directions (for example, "upper", "lower", "left" and "right", as well as other terms such as "clockwise" and "counterclockwise") are used; however, these terms are used for easiness of understanding of the invention by reference to the drawings, and the present invention is not intended to be interpreted in a limited manner by the meanings of the terms. In the image-forming apparatus and developing device described below, those components that are identical or similar to each other are indicated by the same reference numerals.

Figure 3:
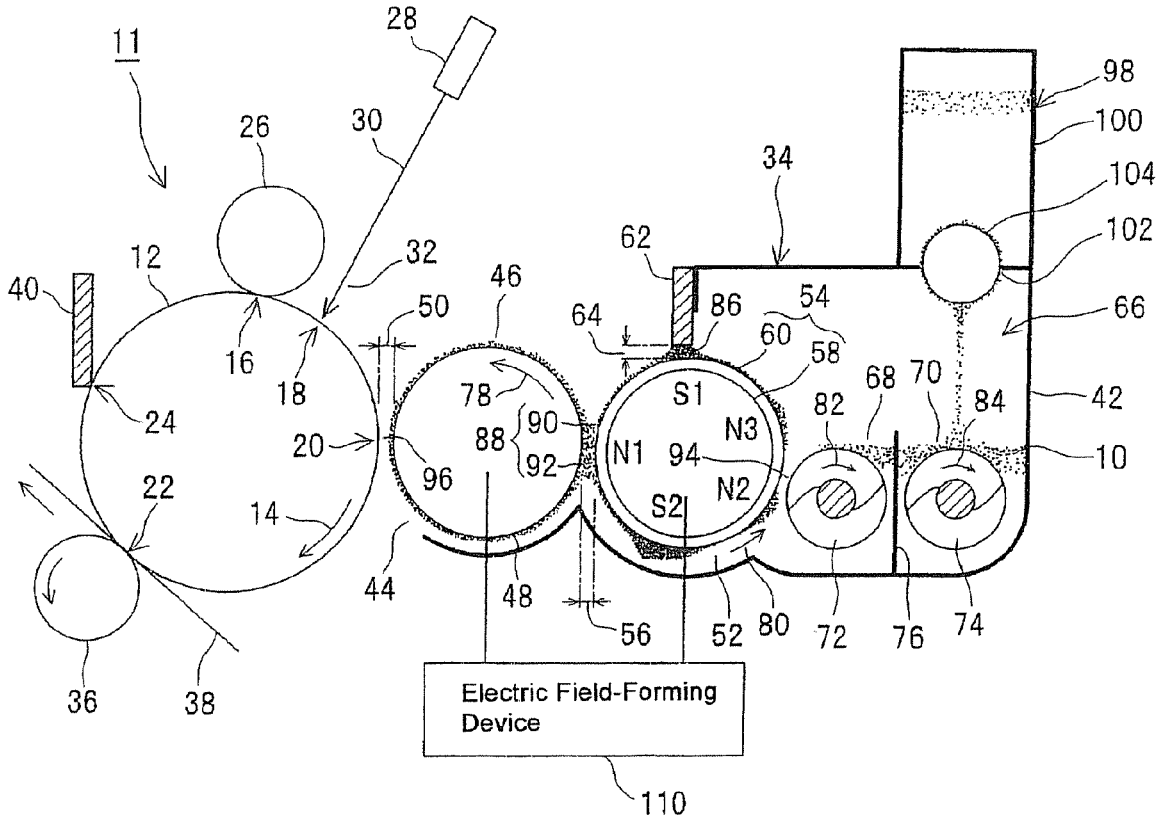
FIG. 3 is a drawing that shows cross sections of an image-forming apparatus of the present invention and a developing device of the present invention.

FIG. 3 shows portions relating to image forming processes of an electrophotographic image-forming apparatus in accordance with the present invention. The image-forming apparatus may be a copying machine, a printer, a facsimile and a composite apparatus having those functions in combination. An image-forming apparatus 11 has a photosensitive member 12 serving as an electrostatic latent image-supporting member. In the embodiment, the photosensitive member 12 is formed into a cylinder shape; however, the present invention is not intended to be limited by this shape, and instead of this, a photosensitive member of an endless belt type may also be used. The photosensitive member 12 is drivably coupled to a motor, not shown, and is allowed to rotate in a direction of arrow 14 based upon the driving operation by the motor. On the periphery of the photosensitive member 12, a charging station 16, an exposing station 18, a developing station 20, a transferring station 22 and a cleaning station 24 are placed in this order along the rotation direction of the photosensitive member 12.

The charging station 16 is provided with a charging device 26 that charges a photosensitive layer corresponding to the outer circumferential face of the photosensitive member 12 to a predetermined potential. In the present embodiment, the charging device 26 is indicated as a cylindrical roller; however, instead of this mode, a charging device of another mode (for example, a brush-type charging device of a rotation-type or a fixed-type, and a wire discharging-type charging device) may also be used. The exposing station 18 is provided with a passage 32 that allows image-forming light 30, released from an exposing device 28 placed at a position near the photosensitive member 12 or apart from the photosensitive member 12, to proceed toward the outer circumferential face of the charged photosensitive member 12. On the outer circumferential face of the photosensitive member 12 that has passed through the exposing station 18, an electrostatic latent image, composed of a portion on which the image-forming light is applied so that the electrical potential has been damped and a portion on which the charging potential is virtually maintained, is formed. In the present embodiment, the portion having the damped potential forms an electrostatic latent image portion and the portion on which the charging potential is virtually maintained forms the electrostatic latent non-image portion. The developing station 20 has a developing device 34 that visualizes the electrostatic latent image by using a powder developer. The developing device 34 will be described later in detail. The transferring station 22 has a transferring device 36 that transfers the visible image formed on the outer circumferential face of the photosensitive member 12 onto a sheet 38 such as paper and a film. In the present embodiment, the transferring device 36 is indicated as a cylindrical roller; however, a transferring device having another mode (for example, a wire discharging-type transferring device) may also be used. The cleaning station 24 has a cleaning device 40 that recovers residual un-transferred toner on the outer circumferential face of the photosensitive member 12 which has not been transferred onto the sheet 38 in the transferring station 22, from the outer circumferential face of the photosensitive member 12. In the present embodiment, the cleaning device 40 is indicated as a plate-shaped blade; however, instead of this mode, a cleaning device of another mode (for example, a brush-type cleaning device of a rotation-type or fixed type) may also be used.

Upon forming an image in the image-forming apparatus 11 having the above-mentioned structure, the photosensitive member 12 is driven by the motor (not shown) to rotate clockwise. At this time, the outer circumferential portion of the photosensitive member passing through the charging station 16 is charged by the charging device 26 to a predetermined potential. The outer circumferential portion of the photosensitive member thus charged is exposed by the image-forming light 30 in the exposing station 18 so that an electrostatic latent image is formed thereon. The electrostatic latent image is transported to the developing station 20 together with the rotation of the photosensitive member 12, and visualized therein as a developer image by the developing device 34. The developer image thus visualized is transported to the transferring station 22 together with the rotation of the photosensitive member 12, and transferred onto a sheet 38 therein by the transferring device 36. The sheet 38 with the developer image transferred thereon is transported to a fixing station, not shown, where the developer image is fixed onto the sheet 38. The outer circumferential portion of the photosensitive member that has passed through the transferring station 22 is transported to the cleaning station 24 where residual developer on the outer circumferential face of the photosensitive member 12 is recovered without being transferred onto the sheet 38.

[Developing Device]

The developing device 34 is provided with a developer tank (housing) 42 that houses a two-component developer comprising a non-magnetic toner forming first component particles and a magnetic carrier (the above-mentioned carrier of the present invention) forming second component particles, and various members described below. For easiness of understanding of the present invention, the drawing is simplified by omitting one portion of the developer tank 42. The developer tank 42 has a series of openings (44, 52) that are opened toward the photosensitive member 12, and a developing roller 48, which serves as a toner transporting member (second transporting member), is placed in a space 46 formed near the opening portion 44. The developing roller 48, which is a cylindrical member (second rotation cylindrical member), is rotatably disposed in parallel with the photosensitive member 12 and via a predetermined developing gap 50 being interposed relative to the outer circumferential face of the photosensitive member 12.

On the back of the developing roller 48, another space 52 serving as an opening portion is formed. In the space 52, a transporting roller 54, which serves as a developer transporting member (first transporting member), is disposed in parallel with the developing roller 48 and via a predetermined supply/recovery gap 56 being placed relative to the outer circumferential face of the developing roller 48. The transporting roller 54 is provided with a magnet member 58 unrotatably fixed, and a cylindrical sleeve 60 (first rotation cylinder member) rotatably supported around the magnet member 58. Above the sleeve 60, a regulating plate 62 that is fixed to the developer tank 42 and extends in parallel with the center axis of the sleeve 60 is placed so as to face the sleeve 60 via a predetermined regulating gap 64.

The magnet member 58 is allowed to face the inner face of the transporting roller 54 and has a plurality of magnetic poles that extends in the center axis direction of the transporting roller 54. In the present embodiment, the magnetic poles include a magnetic pole S1 facing to the upper inner circumferential face portion of the transporting roller 54 near the regulating plate 62, a magnetic pole N1 facing to the left-side inner circumferential face portion of the transporting roller 54 near the supply/recover gap 56, a magnetic pole S2 facing to the lower inner circumferential face portion of the transporting roller 54 and two adjacent magnetic poles N2 and N3 having the same polarity, which face to the right-side inner circumferential face portion of the transporting roller 54.

On the back of the transporting roller 54, a developer stirring chamber 66 is formed. The stirring chamber 66 has a front chamber 68 formed near the transporting roller 54 and a rear chamber 70 placed apart from the transporting roller 54. In the front chamber 68, a front screw 72, which serves as a front stirring transport member that transports the developer from the surface side toward the back face side of Figure, while stirring the developer, is rotatably placed, and in the rear chamber 70, a rear screw 74, which serves as a rear stirring transport member that transports the developer from the back face side to the surface side of Figure, while stirring the developer, is rotatably placed. As illustrated, the front chamber 68 and the rear chamber 70 may be separated from each other by a partition wall 76 placed between the two chambers. In this case, the partition wall portions near the two ends of the front chamber 68 and the rear chamber 70 are removed so as to form a communicating passage; thus, the developer that has reached the end portion on the downstream side of the front chamber 68 is sent to the rear chamber 70 through the communicating passage, while the developer that has reached the end portion on the downstream side of the rear chamber 70 is sent to the front chamber 68 through the communication passage.

The following description will be discussed about operations of the developing device 34 having the above-mentioned structure. Upon forming an image, the developing roller 48 and the sleeve 60 are driven by the motor, not shown, to rotate in respective directions indicated by arrows 78 and 80. The front screw 72 is rotated in a direction indicated by an arrow 82, and the rear screw 74 is rotated in a direction indicated by an allow 84. Consequently, the developer 10, housed in the developer stirring chamber 66, is stirred with being transported and circulated between the front chamber 68 and the rear chamber 70. As a result, the toner and the carrier contained in the developer are made in frictionally contact with each other to be charged to mutually reversed polarities.

The charged developer 10 is supplied to the transporting roller 54 while being transported from the front chamber 68 by the front screw 72. The developer 10, supplied to the transporting roller 54 by the front screw 72, is held on the outer circumferential face of the sleeve 60 near the magnetic pole N3 by the magnetic force of the magnetic pole N3. The developer 10, which is held on the sleeve 60, forms a magnetic brush along lines of magnetic force formed by the magnetic member 58, and is transported counterclockwise by the rotation of the sleeve 60. The developer 10, held by the magnetic pole S1 at a facing area (regulating area 86) to the regulating plate 62, is regulated in its amount for passing through a regulating gap 64 into a predetermined amount by the regulating plate 62. The developer 10 that has passed through the regulating gap 64 is transported to an area (supply/recovery area) 88 which faces the magnetic pole N1, with the developing roller 48 and the transporting roller 54 being made face to face with each other. Mainly in an area (supply area) 90 within the supply/recovery area 88, located on the upstream side in the rotation direction of the sleeve 60, the toner adhering to the carrier is electrically supplied to the developing roller 48 by a magnetic field formed between the developing roller 48 and the sleeve 60. Mainly in an area (recovery area) 92 within the supply/recovery area 88 located on the downstream side in the rotation direction of the sleeve 60, the toner on the developing roller 48 that has been returned to the supply/recovery area 88 without having been used for the developing process is scraped by the magnetic brush formed along the lines of magnetic force of the magnetic pole N1, and recovered onto the sleeve 60. The carrier is held on the outer circumferential face of the sleeve 60 by the magnetic force of the magnetic member 58, and is not allowed to move from the sleeve 60 onto the developing roller 48. In the carrier used in the present invention, after the carrier has supplied the toner at the supply area 90 on the sleeve 60, a reversed charge to that of the toner is newly generated by mutual frictional contact among the carriers, at the inorganic compound sites on the resin layer surface possessed by the carrier. For this, the carrier attracts and recovers the toner more effectively electrically at the inorganic compound sites in the recovery area 92.

The developer 10 that has passed through the supply/recovery area 88 is held by the magnetic force of the magnet member 58, and upon arrival onto a facing area (release area 94) to the magnetic poles N2 and N3 after passing through the facing portion to the magnetic pole S2 by the rotation of the sleeve 60, it is released from the outer circumferential face of the sleeve 60 to the front chamber 68 by a repulsive magnetic field formed by the magnetic poles N2 and N3, and mixed with the developer 10 transported in the front chamber 68.

The toner, held by the developing roller 48 in the supply area 90, is transported counterclockwise by the rotation of the developing roller 48, and allowed to adhere to an electrostatic latent image portion formed on the outer circumferential face of the photosensitive member 12 in an area (developing area) 96 where the photosensitive member 12 and the developing roller 48 are made face to face with each other. In the image-forming apparatus of the present embodiment, a predetermined negative electric potential $V_H$ is applied to the outer circumferential face of the photosensitive member 12 by the charging device 26, and the electrostatic latent image portion to which the image light 30 has been projected by the exposing device 28 is damped to a predetermined electric potential $V_L$, while the electrostatic latent non-image portion which has not been subjected to the image light 30 by the exposing device 28 is virtually maintained at the charging electric potential $V_H$. Therefore, in the developing area 96, the negatively charged toner is allowed to adhere to the electrostatic latent image portion by the operation of the electric field formed between the photosensitive member 12 and the developing roller 48 so that the electrostatic latent image is visualized as a developer image.

When the toner has been consumed from the developer 10 in this manner, the toner is preferably supplied to the developer 10 in the amount corresponding to the consumed amount. For this, the developing device 34 is provided with a means for measuring the mixed ratio of the toner and the carrier housed in the developer tank 42. A toner supply unit 98 is placed above the rear chamber 70. The toner supply unit 98 has a container 100 used for housing the toner. An opening 102 is formed on the bottom of the container 100, and a supply roller 104 is attached to the opening 102. The supply roller 104 is drivably coupled to a motor, not shown, and the motor is driven based upon the output of the means for measuring the mixed ratio of the toner and the carrier so that the toner is dropped into the rear chamber 70 to be supplied.

[Electric-Field Forming Means]

In order to efficiently transfer the toner from the sleeve 60 to the developing roller 48 in the supply area 90, the developing roller 48 and the sleeve 60 are electrically connected to an electric-field forming device 110. FIGS. 4A to 8 show specific examples of power supplies.

Figure 4A:
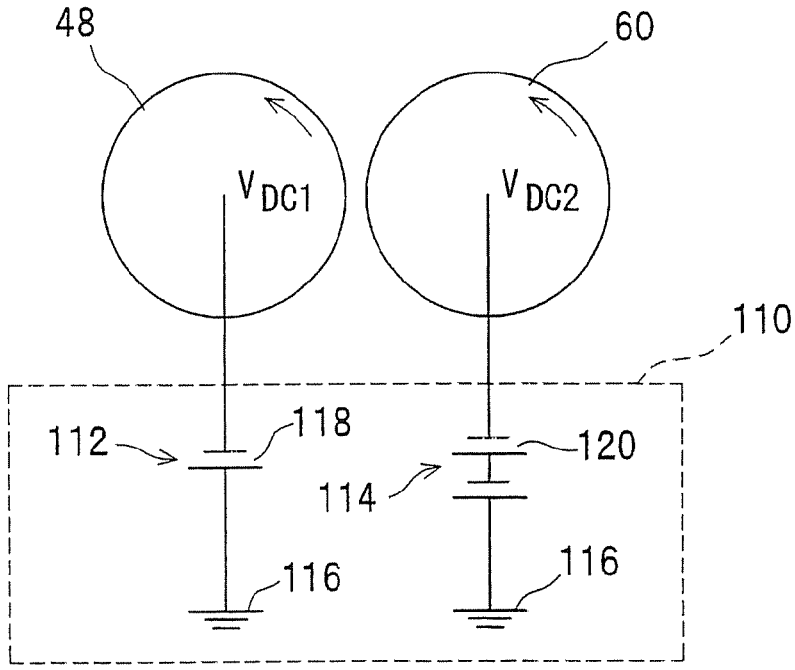
FIG. 4A is a drawing that shows one embodiment of an electric field-forming device.
Figure 4B:
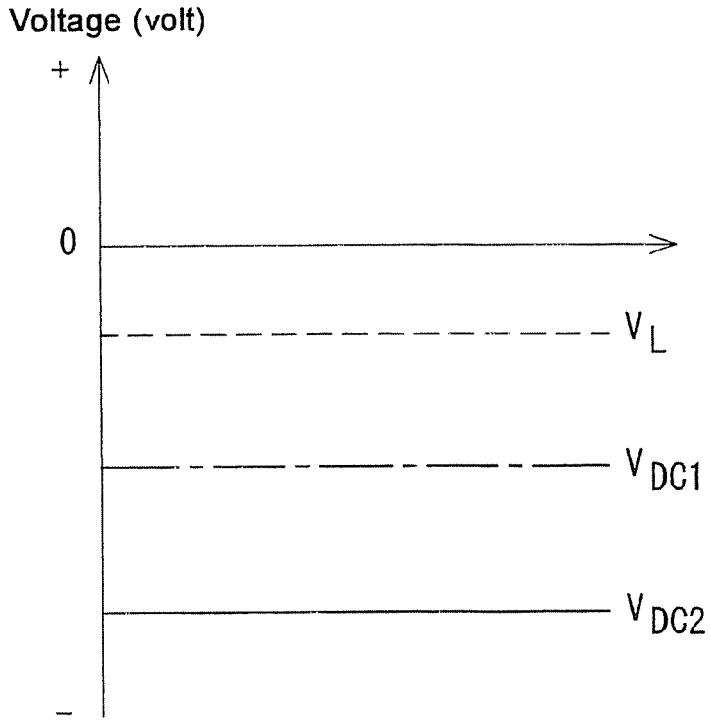
FIG. 4B is a drawing that shows a relationship of voltages that are supplied to a sleeve and a developing sleeve from the electric field-forming device shown in FIG. 4A.

The electric-field forming device 110 of Embodiment 1 shown in FIG. 4A has a first power supply 112 (corresponding to a second electric-field forming means) connected to the developing roller 48 and a second power supply 114 (corresponding to a first electric-field forming means) connected to the sleeve 60. The first power supply 112 has a DC power supply 118 connected between the developing roller 48 and the ground 116, and applies a first DC voltage $V_{DC1}$ (for example, −200 V) having the same polarity as the charged polarity of the toner to the developing roller 48. The second power supply 114 has a DC power supply 120 connected between the sleeve 60 and the ground 116, and applies a second DC voltage $V_{DC2}$ (for example, −400 V) having the same polarity as the charged polarity of the toner and a voltage higher than the first DC voltage to the sleeve 60. As a result, within the supply area 90, the toner, charged to the negative polarity by the operation of a pulsating electric field formed between the developing roller 48 and the sleeve 60, is electrically attracted from the sleeve 60 to the developing roller 48. At this time, the carrier, charged to the positive polarity, is not attracted from the sleeve 60 to the developing roller 48. Within the developing area 96, as shown in FIG. 4B, the toner having the negative polarity, held by the developing roller 48, is allowed to adhere to an electrostatic latent image portion based upon a potential difference between the developing roller 48 ($V_{DC1}$: −200 V) and the electrostatic latent image portion ($V_L$: −80 V). At this time, the toner having the negative polarity is not allowed to adhere to the electrostatic latent non-image portion by the potential difference between the developing roller 48 ($V_{DC1}$: −200 V) and the electrostatic latent non-image portion ($V_H$: −600 V).

Figure 5A:
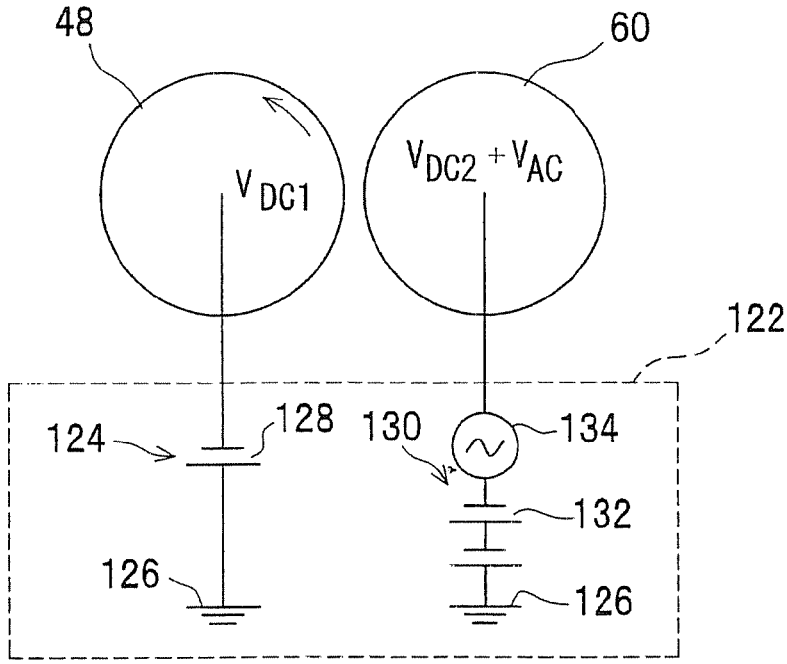
FIG. 5A is a drawing that shows another embodiment of the electric field-forming device.
Figure 5B:
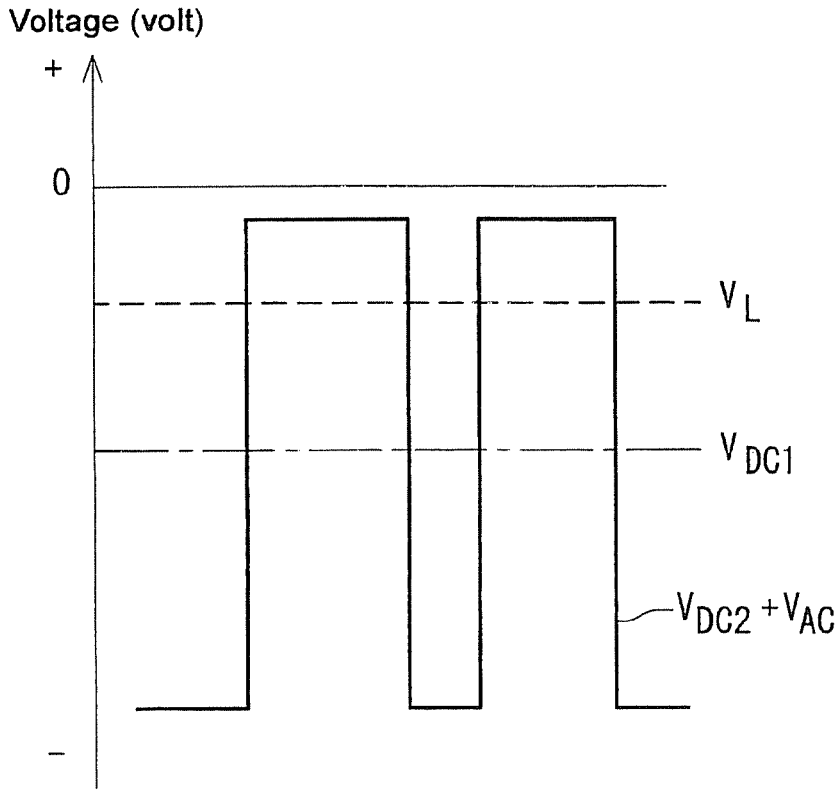
FIG. 5B is a drawing that shows a relationship of voltages that are supplied to a sleeve and a developing sleeve from the electric field-forming device shown in FIG. 5A.

In an electric-field forming device 122 shown in FIG. 5A relating to Embodiment 2, a first power supply 124 (corresponding to a second electric-field forming means) has a DC power supply 128 connected between the developing roller 48 and the ground 126 in the same manner as in the power supply of Embodiment 1, and applies a first DC voltage $V_{DC1}$ (for example, −200 V) having the same polarity as the charged polarity of the toner to the developing roller 48. A second power supply 130 has a DC power supply 132 and an AC power supply 134, connected between the sleeve 60 and the ground 126. The DC power supply 132 applies a second DC voltage $V_{DC2}$ (for example, −400 V) having the same polarity as the charged polarity of the toner and a voltage higher than the first DC voltage to the sleeve 60. As shown in FIG. 5B, the AC power supply 134 applies an AC voltage $V_{AC}$ of, for example, 300 V in its peak-to-peak voltage $V_{P-P}$, between the sleeve 60 and the ground 126. As a result, within the supply area 90, the toner, charged to the negative polarity by the operation of a pulsating-current electric field formed between the developing roller 48 and the sleeve 60, is electrically attracted from the sleeve 60 to the developing roller 48. At this time, the carrier, charged to the positive polarity, is held on the sleeve 60 by a magnetic force of the fixed magnet inside the sleeve 60, and not supplied to the developing roller 48. Within the developing area 96, the toner having the negative polarity, held by the developing roller 48, is allowed to adhere to an electrostatic latent image portion based upon a potential difference between the developing roller 48 ($V_{DC1}$: −200 V) and the electrostatic latent image portion ($V_L$: −80 V).

Figure 6A:
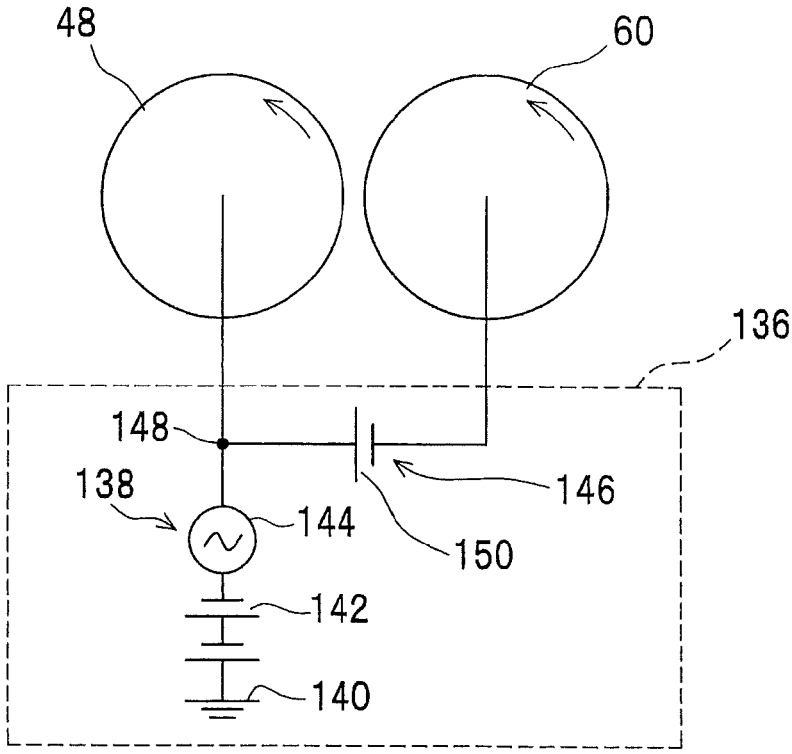
FIG. 6A is a drawing that shows another embodiment of the electric field-forming device.
Figure 6B:
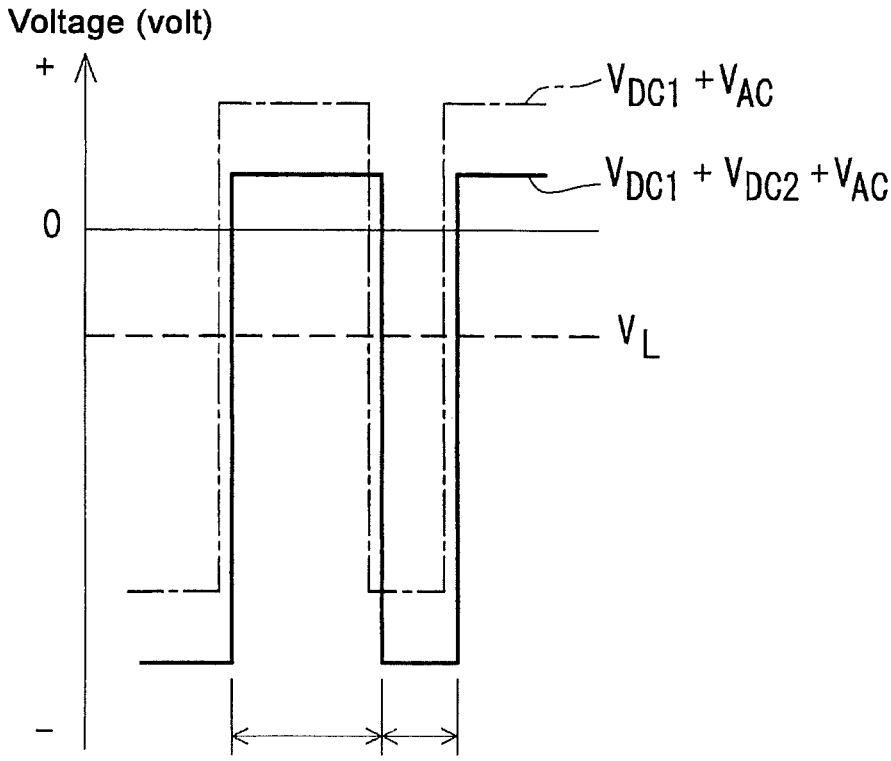
FIG. 6B is a drawing that shows a relationship of voltages that are supplied to a sleeve and a developing sleeve from the electric field-forming device shown in FIG. 6A.

In an electric-field forming device 136 shown in FIG. 6A, a first power supply 138 has a DC power supply 142 and an AC power supply 144 connected between the developing roller 48 and the ground 140. The DC power supply 142 applies a first DC voltage $V_{DC1}$ (for example, −200 V) having the same polarity as the charged polarity of the toner to the sleeve 60 and the developing roller 48. The AC power supply 144 applies an AC voltage $V_{AC}$ having an amplitude (peak-to-peak voltage) $V_{P-P}$ of about 1, 600 V between the sleeve 60 as well as the developing roller 48 and the ground 140. A second power supply 146 (corresponding to a first electric-field forming means) has a DC power supply 150 connected between a terminal 148 between the developing roller 48 and the AC power supply 144, and sleeve 60. The DC power supply 150 can output a predetermined DC voltage $V_{DC2}$, with its anode being connected to the terminal 148 and its cathode being connected to the sleeve 60, so that the sleeve 60 is biased to the negative polarity relative to the developing roller 48 (see FIG. 6B). Therefore, within the supply area 90, the toner, charged to the negative polarity, is electrically attracted from the sleeve 60 to the developing roller 48 by the operation of a pulsating-current electric field formed between the developing roller 48 and the sleeve 60. Within the developing area 96, the toner having the negative polarity on the developing roller 48 is allowed to adhere to an electrostatic latent image portion based upon a potential difference between the developing roller 48 ($V_{DC1}$: −200 V) and the electrostatic latent image portion ($V_L$: −80 V).

Figure 7:
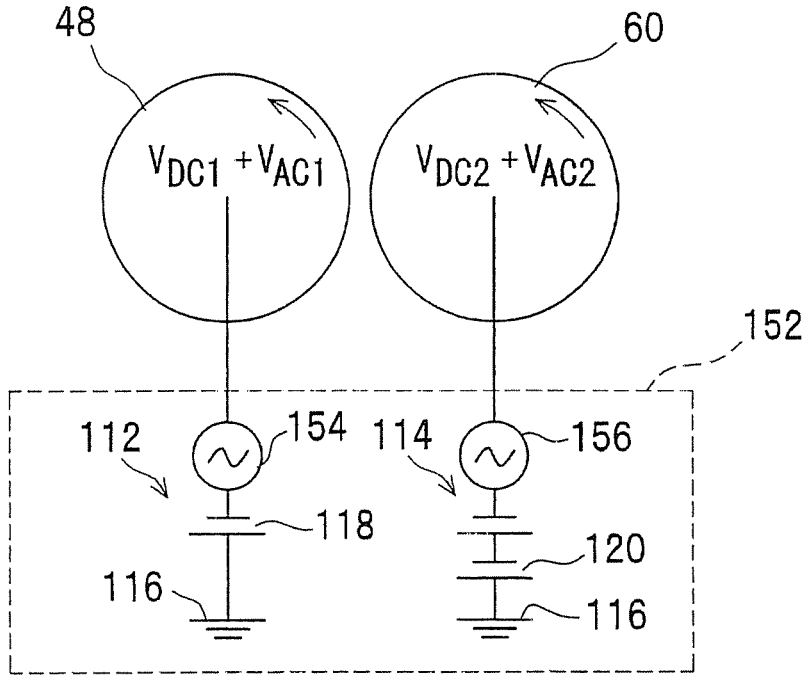
FIG. 7 is a drawing that shows another embodiment of the electric field-forming device.
Figure 8:
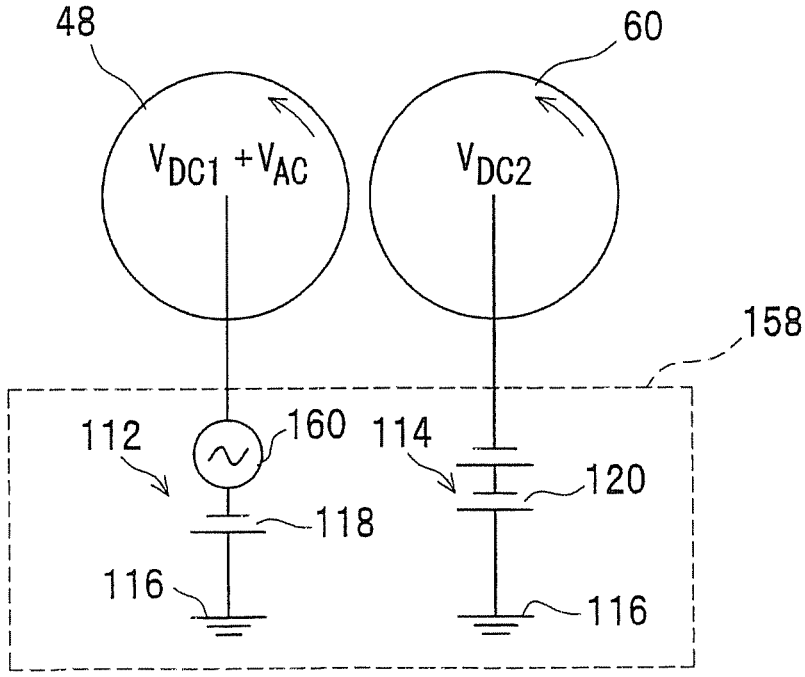
FIG. 8 is a drawing that shows another embodiment of the electric field-forming device.

An electric-field forming device 152 shown in FIG. 7 has a structure in which AC power supplies 154 and 156 are respectively added to the first power supply 112 and the second power supply 114 in the electric-field forming device 110 of Embodiment 1 shown in FIG. 4A. The output voltages of the AC power supplies 154 and 156 are indicated by $V_{AC1}$ and $V_{AC2}$. The voltages $V_{AC1}$ and $V_{AC2}$ may be the same, or may be different from each other. An electric-field forming device 158 shown in FIG. 8 has a structure in which an AC power supply 160 is added to the first power supply 112 in the power supply in the embodiment shown in shown in FIG. 4A. The output voltage of the AC power supply 160 is represented by $V_{AC}$. Also in these electric-field forming devices 152 and 158, within the supply area 90, the toner charged to the negative polarity is supplied from the sleeve 60 to the developing roller 48 by the operation of a pulsating-current electric field formed between the developing roller 48 and the sleeve 60 in the same manner as in the electric-field forming devices 110, 122 and 136 so that within the developing area 96, the toner charged to the negative polarity is supplied from the developing roller 48 to an electrostatic latent image portion based upon a potential difference from the electrostatic latent image portion ($V_L$: −80 V)

EXAMPLES

The present invention will be described by means of examples; however, it is clear that the present invention should not be interpreted in a limited manner by the examples.

Example 1

Production of Carrier A

First, a polystyrene-butyl methacrylate resin having a number-average molecular weight Mn of 8000, a weight-average molecular weight Mw of 240000 and Tg of 59° C. was dissolved in tetrahydrofran to prepare a solution of 10% by weight. The resulting solution was applied to MnZn ferrite balls having a particle size of 30 μm so as to be coated therewith by a spray drying method so that an intermediate layer having a thickness of 0.4 μm was formed.

Next, a resin layer containing basic particles was formed on the above-mentioned coated particles. More specifically, first, the same polystyrene-butyl methacrylate resin as described above was dissolved in tetrahydrofran to prepare a solution of 10% by weight. To this solution was added zinc oxide particles with a particle size of 0.2 μm dried at 200° C., by an amount of 40 parts by weight relative to 100 parts by weight of the dissolved resin, and dispersed. The above-mentioned ferrite halls, having the intermediate layer, were coated with the resulting dispersion solution by using a rolling fluidizer, and then dried so that a carrier A (average particle size: 31 μm) was manufactured. The thickness of the resin layer was 0.5 μm.

(Acidity/Basicity Property Measurements on Inorganic Compound)

The same zinc oxide (3 parts by weight) as described above was added into 100 parts by weight of cyclohexane, and when three drops of a basic indicator, bromothymol blue dissolved in cyclohexane, were put into the dispersion solution, the solution was changed to blue, indicating that the zinc oxide has basic points.

(Chargeability Measurements on Inorganic Compound)

The same zinc oxide (2% by weight in mixing ratio) as described above was mixed with resin particles (weight-average particle size: 5 μm) made of the same polystyrene-butyl methacrylate resin as described above, and the quantity of charge of the zinc oxide was measured by a blow-off method. The quantity of charge was +65 μC/g, so that it was confirmed that the zinc oxide exhibited a positive chargeability with respect to the resin.

(Production of Toner A (Negatively Chargeable Toner))

A polyester resin (100 parts by weight) having a number-average molecular weight Mn of 7000, a weight-average molecular weight Mw of 210000 and Tg of 61° C. was mixed with 3 parts by weight of an aluminum-based salicylic acid compound serving as a negative-charge controlling agent (Bontron S-34 manufactured by Orient Chemical Inc.) and 5 parts by weight of carbon black by using a high-speed shearing mixer, to be subjected to a thermal kneading process. Then, the resulting mixture was cooled, pulverized and classified to give toner particles having a weight-average particle size of 6 μm. To the resulting toner particles was added and mixed therewith 1.0% by weight of colloidal silica having an average primary particle size of 30 nm, so that a toner A was obtained.

(Evaluation)

The toner A was added to the carrier A so as to have a toner-mixed ratio of 13% by weight, and mixed and stirred to give a developer.

Figure 9:
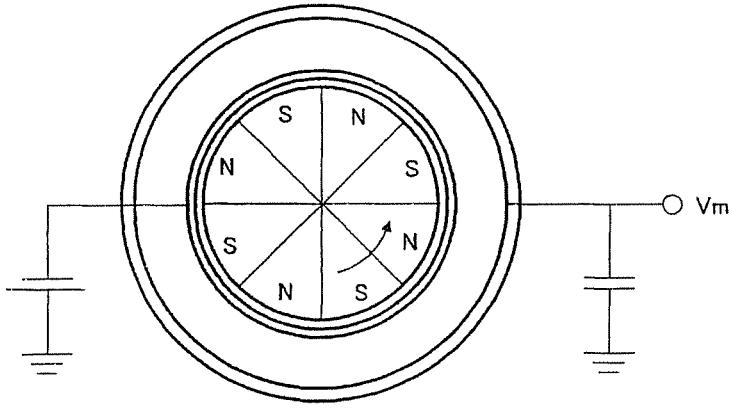
FIG. 9 is a drawing that shows an electric field separation method for measuring the quantity of charge of toner.

By using the resulting developer, the quantity of charge in the toner was measured by an electric-field separation method as shown in FIG. 9. This device was provided with a magnetic roller having a rotatable sleeve and an unrotatable conductive cylinder placed on the outside thereof. The magnetic roller mounting the developer thereon was rotated, and the toner was captured onto the tube, with a weak electric field being applied between the sleeve and the tube on the outside. The tube was connected to a capacitor so that the total quantity of charge of the toner thus captured could be measured. Simultaneously, the weight of the captured toner was measured so that the quantity of charge per weight was calculated; thus, the quantity of charge of the toner was obtained. The quantity of charge of the toner was −45 μC/g.

This developer was loaded into an image-forming apparatus (bizhus C450: made by Konica Minolta Business Technologies, Inc.) shown in FIG. 3, and subjected to actual copying tests. An evaluation chart, which had a bold character having an ID=1.5 at a position with 2 cm from the tip in the entire half-tone image having an ID=0.6, was used (see FIG. 10(A)). The test conditions are as follows: Vo of the photosensitive member=−500 V, Vdc (developing roller): −300 V, Vdc (transporting roller): −500 V, AC (developing roller, transporting roller): Vpp 2 kV, frequency 2 kHz.

As a result of the actual copying tests under these conditions, a superior image was obtained without ghost.

Comparative Example 1

Production of Carrier B

By using the same method as that of the carrier A except that the zinc oxide was not adopted, a carrier B was manufactured.

(Evaluation)

Evaluation was made by using the same method as that of Example 1 except that the carrier B was used.

The quantity of charge of the toner was −30 μC/g, which was smaller than that of Example 1. The reason for this is because the carrier B contains no zinc oxide for negatively charging the toner.

Figure 10:
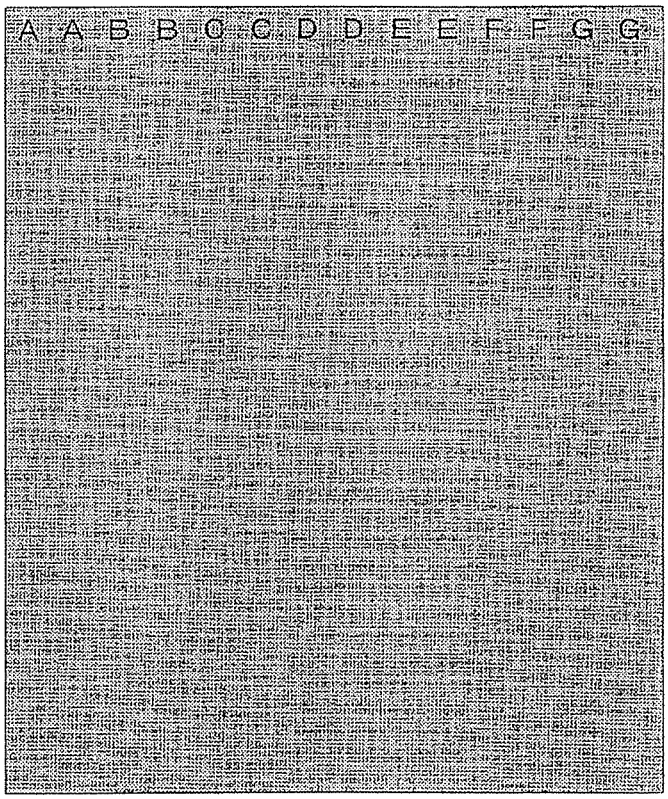
FIG. 10(A) is a drawing that shows an image used for evaluation.
FIG. 10(B) is a drawing that shows an image in which a ghost is generated.
Figure 10:
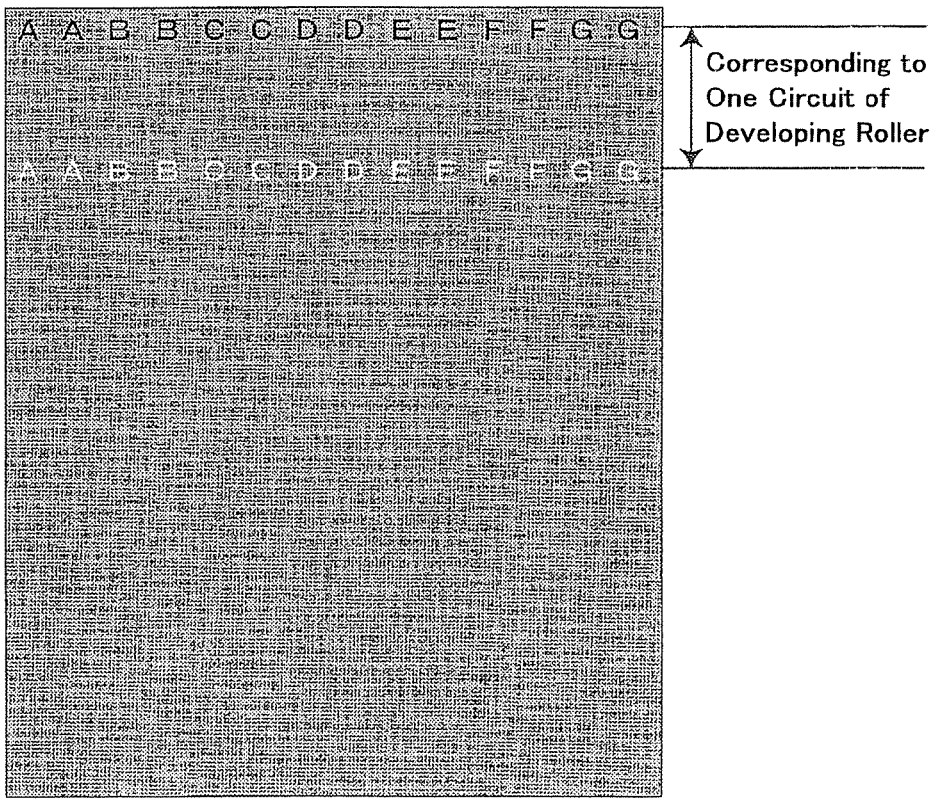
Figure 11:
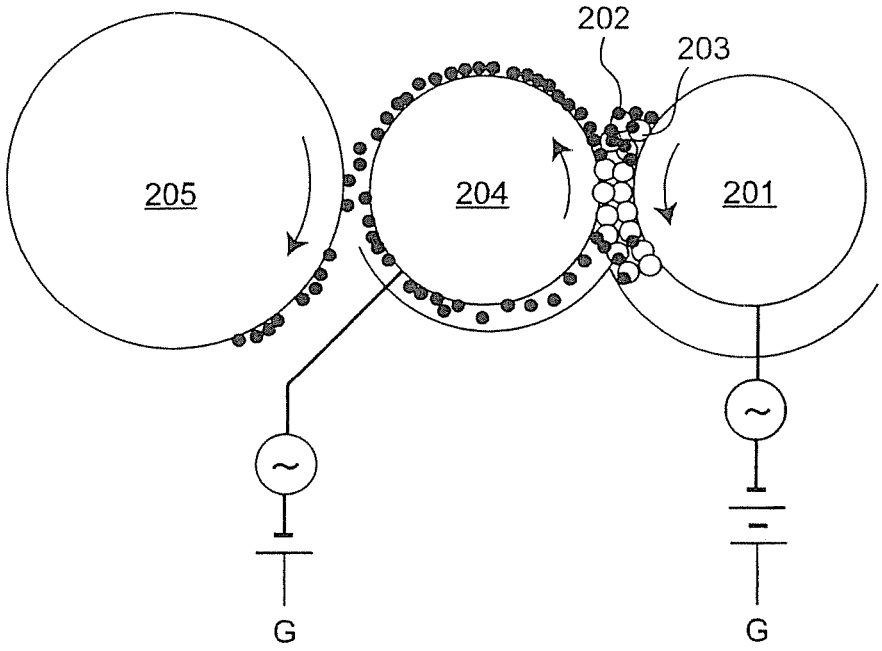
FIG. 11 is a schematic drawing that shows one example of a hybrid developing system.

In spite of the fact that, in general, the smaller the quantity of charge of the toner, the smaller the mirror-imaging force relative to the developing roller, it becomes to hardly cause ghost, the actual copying tests caused serious ghosts (see FIG. 10(B)).

Example 2

Production of Carrier C

The same method as that of the carrier A was used except that instead of the polystyrene-butyl methacrylate resin, a polyester resin having a weight-average molecular weight of 240000, a number-average molecular weight of 8000 and Tg of 62° C. was used and that instead of the zinc oxide, alumina having a particle size of 0.3 μm was used, so that a carrier C was manufactured.

(Acidic/Basicity Measurements on Inorganic Compound)

An indicator test was carried out by using the same method as that of Example 1 except that the same alumina as described above was used, and it was confirmed that the alumina had basic points.

(Chargeability Measurements on Inorganic Compound)

By using the same method as that of Example 1 except that the same alumina described above was used and resin particles (weight-average particle size: 5 μm) made from the same polyester resin as described above were used, the quantity of charge of the alumina was measured. The quantity of charge was +75 μC/g, and it was confirmed that the alumina exhibited a positive chargeability with respect to the resin.

(Evaluation)

Evaluation was made by using the same method as that of Example 1 except that the carrier C was used.

The quantity of charge of the toner was −38 μC/g.

In actual copying tests, a superior image was obtained without ghost.

Example 3

Production of Carrier D

The same method as that of the carrier A was used except that instead of the zinc oxide, magnesium oxide having a particle size of 0.5 μm was used, so that a carrier D was manufactured.

(Acidic/Basicity Measurements on Inorganic Compound)

The same magnesium oxide (5 parts by weight) as described above was added to 100 parts by weight of cyclohexane, and when three drops of a basicity indicator, nitrodiphenyl amine dissolved in cyclohexane, were put into the dispersion solution, the solution was changed into orange, indicating that the magnesium oxide had basic points.

(Chargeability Measurements on Inorganic Compound)

By using the same method as that of Example 1 except that the same magnesium oxide described above was used, the quantity of charge of the magnesium oxide was measured. The quantity of charge was +80 μC/g, and it was confirmed that the magnesium oxide exhibited a positive chargeability with respect to the resin.

(Evaluation)

Evaluation was made by using the same method as that of Example 1 except that the carrier D was used.

The quantity of charge of the toner was −40 μC/g.

In actual copying tests, a superior image was obtained without ghost.

Example 4

Production of Carrier E

A polystyrene-butyl methacrylate-acrylic acid copolymer resin having a number-average molecular weight Mn of 6000, a weight-average molecular weight Mw of 20000 and Tg of 58° C. was dissolved in tetrahydrofran to prepare a solution of 10% by weight. The resulting solution was applied to MnMg ferrite balls having a particle size of 40 μm so as to be coated therewith by a spray drying method so that an intermediate layer having a thickness of 0.2 μm was formed to prepare a carrier precursor.

Then, the basic particles were injected onto the coat layer so that a resin layer was formed. More specifically, 100 parts by weight of the carrier precursor and 0.5% by weight of $SrCO_3$ having a weight-average particle size of 0.3 μm were evenly mixed with each other so that the $SrCO_3$ particles were allowed to adhere to the coat layer surface of the carrier precursor. Thereafter, this was treated by using a hybridizer (Nara Machinery Co., Ltd.) for 10 minutes so that the $SrCO_3$ particles were injected to the coat layer to manufacture a carrier E (average particle size: 40.5 μm).

(Acidic/Basicity Measurements on Inorganic Compound)

An indicator test was carried out by using the same method as that of Example 1 except that the same $SrCO_3$ particles as described above were used, so that it was confirmed that $SrCO_3$ had basic points.

(Chargeability Measurements on Inorganic Compound)

By using the same method as that of Example 1 except that the same $SrCO_3$ described above was used and that resin particles made from the same polystyrene-butyl methacrylate-acrylic acid copolymer resin (weight-average particle size: 20 μm) as described above was used, the quantity of charge of $SrCO_3$ was measured. The quantity of charge was +50 μC/g, and it was confirmed that $SrCO_3$ exhibited a positive chargeability with respect to the resin.

(Evaluation)

Evaluation was made by using the same method as that of Example 1 except that the toner-mixing ratio was set to 11%.

The quantity of charge of the toner was −45 μC/g.

In actual copying tests, a superior image was obtained without ghost.

Example 5

Production of Carrier F

The same method as that of the carrier A was used except that instead of zinc oxide, magnesium sulfate having a particle size of 0.4 μm was used, and that a polystyrene-aminoacrylic resin having a weight-average molecular weight of 200000, a number-average molecular weight of 7500 and an amine value of 10 mg HCl/g was used as a resin so that a carrier F was manufactured.

(Acidic/Basicity Measurements on Inorganic Compound)

The same magnesium sulfate (5 parts by weight) as described above was added into 100 parts by weight of cyclohexane, and when three drops of an acidity indicator, benzalacetophenone dissolved in cyclohexane, were put into the dispersion solution, the solution was changed into red, indicating that the magnesium sulfate had acidic points.

(Chargeability Measurements on Inorganic Compound)

By using the same method as that of Example 1 except that the same magnesium sulfate as described above was used and that beads of 20 μm, made from the same resin as that used for the carrier, were used as resin particles, the quantity of charge of the magnesium sulfate was measured. The quantity of charge was −35 μC/g, and it was confirmed that the magnesium sulfate exhibited a negative chargeability with respect to the resin.

(Production of Toner B (Positively Chargeable Toner))

A polystyrene-methyl methacrylate resin (100 parts by weight) having a number-average molecular weight Mn of 8000, a weight-average molecular weight Mw of 240000 and Tg of 59° C. was mixed with 4 parts by weight of Nigrosine serving as a positive-charge controlling agent (Nigrosine EX manufactured by Orient Chemical Inc.) and 5 parts by weight of carbon black, by using a high-speed shearing mixer, and after this had been subjected to a thermal kneading process, the resulting mixture was subjected to cooling, pulverizing and classifying processes so that toner particles having a weight-average particle size of 6 μm were obtained. To the resulting toner particles was added and mixed therewith 1.0 part by weight of colloidal silica having an average primary particle size of 30 nm so that a toner B was obtained.

(Evaluation)

Evaluation was made by using the same method as that of Example 1 except that the carrier F and the toner B were used, and that the conditions of actual copying tests were changed.

The quantity of charge of the toner was +50 μC/g.

In actual copying tests, a superior image was obtained without ghost. The test conditions are as follows: Vo of photosensitive member=+500 V, Vdc (developing roller): +300 V, Vdc (transporting roller): +500 V, AC (developing roller, transporting roller): Vpp 2 kV, frequency 2 kHz.

Example 6

Production of Carrier G

The same method as that of the carrier F was used except that instead of the zinc oxide, aluminum chloride having a particle size of 0.5 μm was used, so that a carrier G was manufactured.

(Acidic/Basicity Measurements on Inorganic Compound)

An indicator test was carried out by using the same method as that of Example 5 except that the same aluminum chloride as described above was used, and it was confirmed that the alumina had acidic points.

(Chargeability Measurements on Inorganic Compound)

By using the same method as that of Example 5 except that the same aluminum chloride as described above was used, the quantity of charge of the aluminum chloride was measured. The quantity of charge was −35 μC/g, and it was confirmed that the aluminum chloride exhibited a negative chargeability with respect to the resin.

(Evaluation)

Evaluation was made by using the same method as that of Example 5 except that the carrier G was used.

The quantity of charge of the toner was +45 μC/g.

In actual copying tests, a superior image was obtained without ghost.

As described above, by providing sites having different charging polarities on the carrier surface, the carriers are mutually charged to newly cause a counter charge against the toner, and the toner recovering property is consequently improved so that no ghost is generated.

The presences of both of the positive/negative charging sites are dependent on acidic/basic points that are present on the surface of each of the inorganic compound particles. For example, by placing inorganic compound fine particles having acidic points onto the carrier surface, the carrier exerts a negative chargeability against the toner. At this time, on the carrier surface, the inorganic compound sites are charged to the negative polarity, while the resin sites are charged to the positive polarity. For example, by placing inorganic compound fine particles having basic points onto the carrier surface, the carrier exerts a positive chargeability against the toner. At this time, on the carrier surface, the inorganic compound sites are charged to the positive polarity, while the resin sites are charged to the negative polarity.

What is claimed is:

1. A developer containing a toner and a carrier, the carrier comprising a resin layer formed on an outermost surface, wherein the surface of said resin layer is provided with sites formed of an inorganic compound having acidic points and sites where the resin forming the resin layer is exposed, wherein the sites formed of the inorganic compound and the sites where the resin forming the resin layer is exposed have opposite polarity, and the toner is positively chargeable.

2. The developer of claim 1, wherein the carrier further comprises an intermediate layer and a resin layer being successively formed on a surface of a core particle.

3. A hybrid developing device that visualizes an electrostatic latent image on an electrostatic latent image-supporting member by using a developer containing a toner and a carrier, comprises:

the developer containing the toner and a carrier, the carrier comprising a resin layer formed on an outermost surface in which the surface of said resin layer is provided with sites formed of an inorganic compound having acidic points and sites where the resin forming the resin layer is exposed, wherein the sites formed of the inorganic compound and the sites where the resin forming the resin layer is exposed have opposite polarity, and the toner is positively chargeable;

a first transporting member placed at an opening of a developer tank holding the developer;

a second transporting member that faces the first transporting member via a first area interposed therebetween, and the electrostatic latent image-supporting member via a second area interposed therebetween;

a first electric field-forming means that forms a first electric field between the first transporting member and the second transporting member so that the toner in the developer held by the first transporting member is transported onto the second transporting member; and a second electric field-forming means that forms a second electric field between the second transporting member and the electrostatic latent image-supporting member so that the toner held by the second transporting member is transported onto the electrostatic latent image on the electrostatic latent image-supporting member so as to visualize the electrostatic latent image.

4. The hybrid developing device of claim 3, wherein the carrier further comprises an intermediate layer and a resin layer being successively formed on a surface of a core particle.

5. An image-forming apparatus, comprising a hybrid developing device that visualizes an electrostatic latent image on an electrostatic latent image-supporting member by using a developer containing a toner and a carrier, the hybrid developing device comprising:

the developer containing the toner and a carrier, the carrier comprising a resin layer formed on an outermost surface in which the surface of said resin layer is provided with sites formed of an inorganic compound having acidic points and sites where the resin forming the resin layer is exposed, wherein the sites formed of the inorganic compound and the sites where the resin forming the resin layer is exposed have opposite polarity, and the toner is positively chargeable;

a first transporting member placed at an opening of a developer tank holding the developer;

a second transporting member that faces the first transporting member via a first area interposed therebetween, and the electrostatic latent image-supporting member via a second area interposed therebetween;

a first electric field-forming means that forms a first electric field between the first transporting member and the second transporting member so that the toner in the developer held by the first transporting member is transported onto the second transporting member; and a second electric field-forming means that forms a second electric field between the second transporting member and the electrostatic latent image-supporting member so that the toner held by the second transporting member is transported onto the electrostatic latent image on the electrostatic latent image-supporting member so as to visualize the electrostatic latent image.

6. The image-forming apparatus of claim 5, wherein the carrier further comprises an intermediate layer and a resin layer being successively formed on a surface of a core particle.

* * * * *